US005295811A

United States Patent [19]

Chiu

[11] Patent Number: 5,295,811

[45] Date of Patent: Mar. 22, 1994

[54] PORTABLE FAN WITH ELECTRICAL CONTROL RETAINING STAND

[75] Inventor: Bernard Chiu, Ashland, Mass.

[73] Assignee: Duracraft Corporation, Whitinsville, Mass.

[21] Appl. No.: 800,950

[22] Filed: Dec. 2, 1991

[51] Int. Cl.[5] ..... F04B 35/04

[52] U.S. Cl. ..... 417/423.15; 415/182.1; 415/208.2; 415/213.1; 416/244 R; 416/247 R; 248/127; 248/676; 248/677; 362/394; 403/388; 403/408.1; 361/825

[58] Field of Search ..... 415/182.1, 208.1, 211.2, 415/213.1, 214.1, 208.2; 416/244 R, 247 R; 417/423.7, 423.15; 248/127, 676, 677; 361/419, 427; 403/384, 388, 408.1; 362/96, 394

[56] References Cited

U.S. PATENT DOCUMENTS

| | | | |
|---|---|---|---|
| D. 154,703 | 8/1949 | Phillips | 416/244 R |
| 1,975,934 | 10/1934 | Gilbert et al. | 416/247 R |
| 2,628,020 | 2/1953 | Koch | 415/208.1 |
| 2,795,388 | 6/1957 | Myers | 415/213.1 |
| 2,830,779 | 4/1958 | Wentling | 416/244 R |
| 2,904,298 | 9/1959 | Tateishi | 416/244 R |
| 4,341,151 | 7/1982 | Sakamoto | 416/247 R |

FOREIGN PATENT DOCUMENTS

| | | | |
|---|---|---|---|
| 0129194 | 6/1988 | Japan | 416/244 R |
| 0251605 | 8/1948 | Switzerland | 415/213.1 |
| 0660712 | 11/1951 | U.S.S.R. | 415/208.1 |

OTHER PUBLICATIONS

Vornado Air Comfort System Owner's Guide, Models 280SS, 280LS and 280AE, copyright 1989.

*Primary Examiner*—Edward K. Look
*Assistant Examiner*—Christopher Verdier
*Attorney, Agent, or Firm*—John E. Toupal; Harold G. Jarcho

[57] ABSTRACT

A portable electrical fan including a housing defining inlet and outlet openings for transmitting air flow; a fan blade disposed in the housing; a motor disposed in the housing and rotatably coupled to the fan blade; and an elongated support having opposite end portions attached to the housing and an intermediate stand portion shaped and arranged to support the housing on a surface. Also included are electrical controls connected to the motor and retainer means retaining the electrical controls fixed to the elongated support. This arrangement provides a portable electric fan in an efficient, low cost configuration.

16 Claims, 2 Drawing Sheets

PORTABLE FAN WITH ELECTRICAL CONTROL RETAINING STAND

BACKGROUND OF THE INVENTION

This invention relates generally to a portable electric fan and, more particularly, to a portable electric fan having electrical controls retained by a support stand.

Electric fans are used extensively to reduce personal discomfort caused by excessive temperature. Utilization is enhanced by fans constructed for portability so as to facilitate movement thereof into different locations for placement on support surfaces such as floors, tables, window sills, etc.

The object of this invention is to provide an improved, low cost portable electric fan.

SUMMARY OF THE INVENTION

The invention is a portable electrical fan including a housing defining inlet and outlet openings for transmitting air flow; a fan blade disposed in the housing; a motor disposed in the housing and rotatably coupled to the fan blade; and an elongated support having opposite end portions attached to the housing and an intermediate stand portion shaped and arranged to support the housing on a surface. Also included are electrical controls connected to the motor and retainer means retaining the electrical controls and fixed to the elongated support. This arrangement provides a portable electric fan in an efficient, low cost configuration.

According to certain features of the invention, the retainer means is fixed to one of the end portions, the intermediate portion comprises intersecting leg portions disposed substantially in a given plane, and the opposite end portions project transversely to the given plane. The transversely projecting one end portion provides a convenient support for the electrical controls and the leg portions function as a low cost stand.

According to another feature of the invention, the elongated support is a continuous tubular member. This feature reduces cost of the portable fan.

According to other features of the invention, the housing comprises a substantially cylindrical portion having ends defining the inlet and outlet openings, and terminal portions of the opposite end portions are fixed to substantially diametrically disposed positions on the cylindrical portion. This configuration provides on a fan having an efficient, stable base.

According to yet another feature of the invention, the support defines an aperture, and the retainer means comprises a box retaining the electrical controls a stem received by the aperture and a fastener securing the stem within the aperture. This arrangement simplifies assembly of the portable fan.

According to further features of the invention, the opposite end portions extend in directions having components both parallel and perpendicular to the given plane and the leg portions include three leg portions arranged in a U-shape. This configuration further enhances stability.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
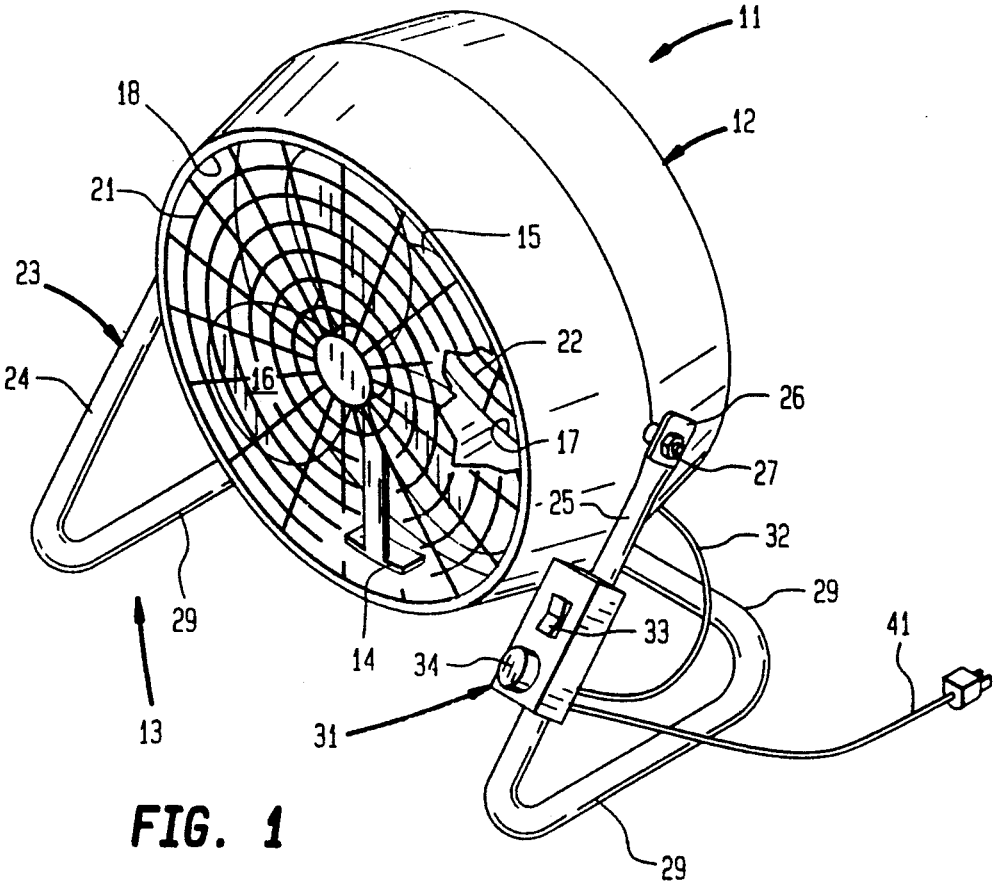
FIG. 1 is a perspective view of a fan according to the invention.
Figure 4:
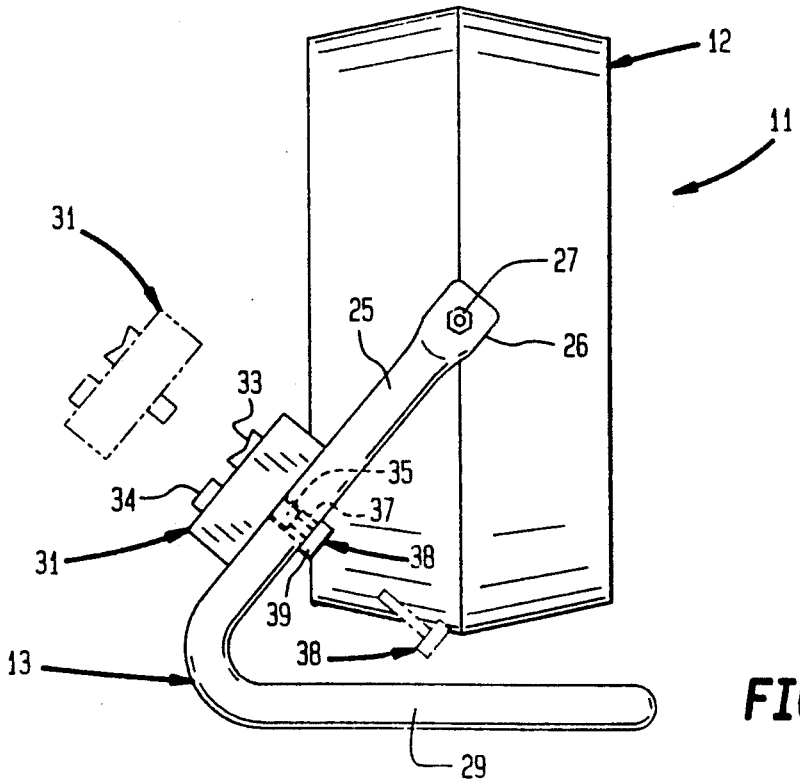
FIG. 4 is a right side view of the fan shown in FIG. 1.
Figure 2:
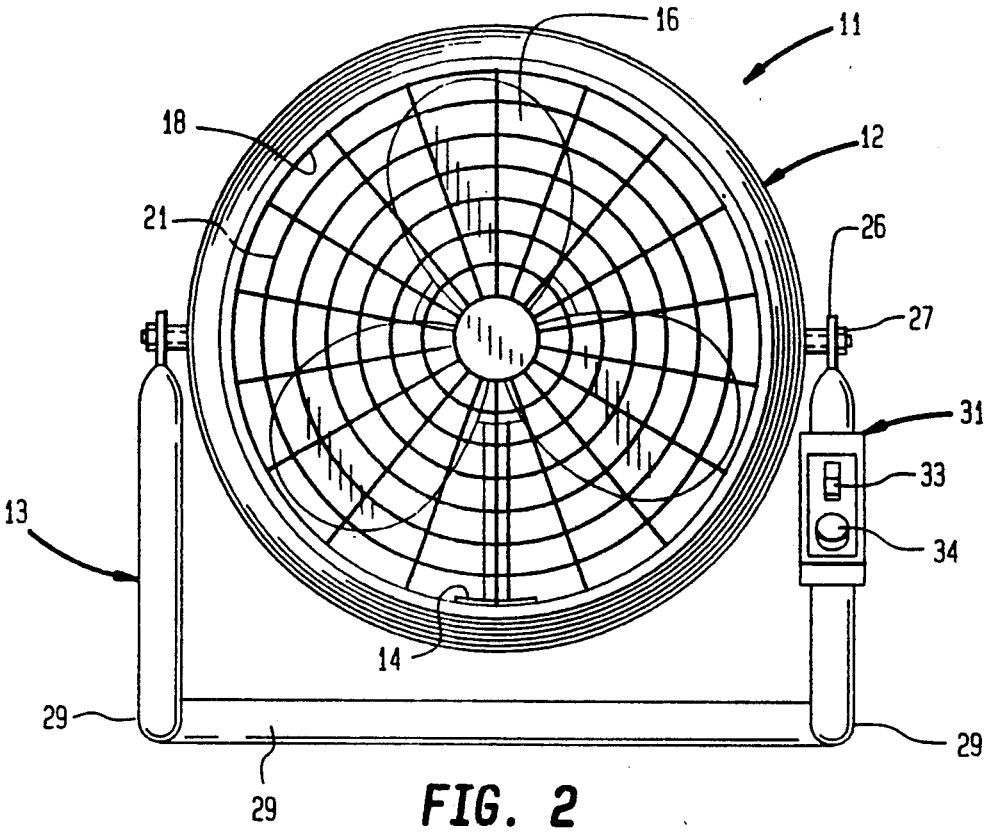
FIG. 2 is a front view of the fan shown in FIG. 1.
Figure 3:
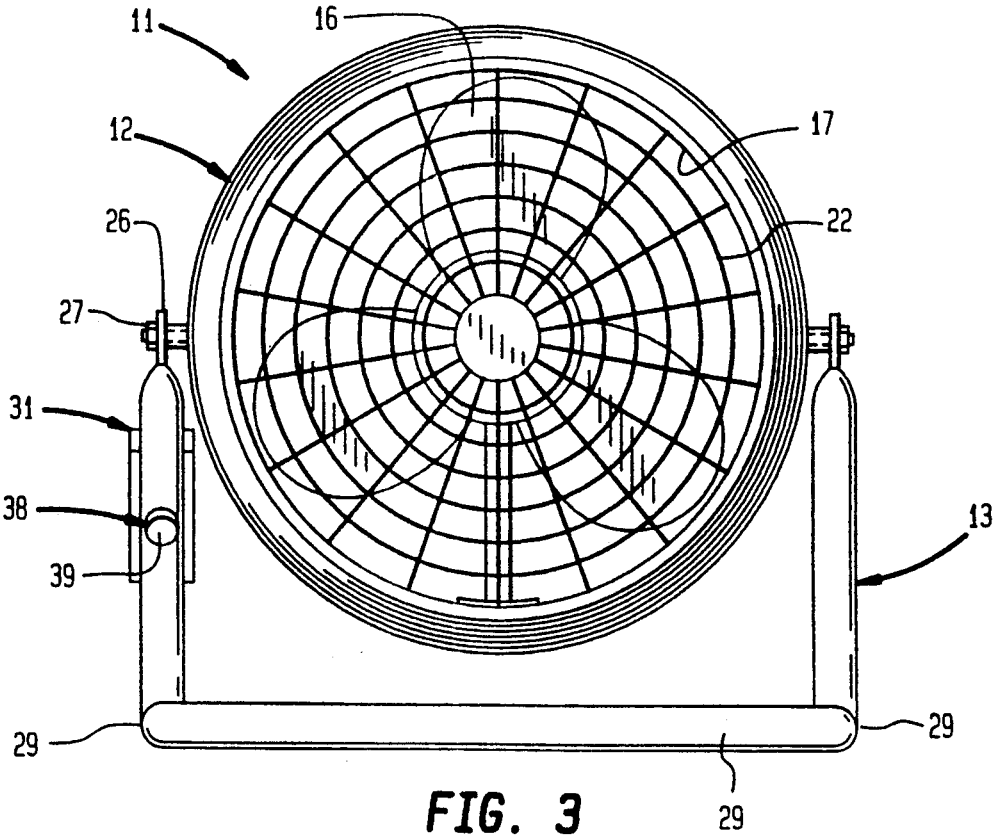
FIG. 3 is a rear view of the fan shown in FIG. 1.

A portable electric fan 11 has a cylindrical housing 12 mounted on a base 13. Supported within the housing 12 by brackets 14 is an electrical motor 15. A fan blade 16 is rotatably coupled to the motor 15 within the housing 12. Opposite ends of the housing define, respectively, an inlet opening 17 and an outlet opening 18 for transmitting air driven by the fan blade 16. Covering the inlet and outlet openings 17, 18, respectively, are grills 21, 22.

The base 13 is formed by an elongated tubular member 23. Opposite end portions 24 and 25 have terminal portions 26 attached to diametrically disposed positions on the housing 12 by retainer screws 27. An intermediate portion of the tubular member 23 is formed by three leg portions 29 disposed in a given plane and arranged in a U-shape as shown. The end portions 24, 25 extend in parallel directions having components both parallel and perpendicular to the given plane.

A control box 31 retains electrical controls connected to the motor 15 by electrical wires 32. Included in the controls are an on-off switch 33 and a fan speed control 34. A locator stem 35 projecting rearwardly from the control box 31 is received by a locator aperture 37 in the end portion 25 of the tubular member 23. Securing the internally threaded stem 35 to the end portion 25 is a fastener screw 38 having a head portion 39 that engages a rear portion of the end portion 25 adjacent to the aperture 37. A power cord 41 is connected to the electrical controls within the control box 31.

Prior to use, the fan 11 is easily transported to a region in which air movement is desired. The U-shaped leg portions 29 are positioned on a suitable planar surface (not shown) so as to provide stable support for the housing 12. Selective manipulation of the on-off switch 33 and the speed control 34 will then produce desired operation of the fan blade 16 to induce air flow through the inlet and outlet openings 17, 18.

Obviously, many modifications and variations of the present invention are possible in light of the above teachings. It is to be understood, therefore, that the invention can be practiced otherwise than as specifically described.

What is claimed is:

1. A portable electrical fan comprising:

housing means defining inlet and outlet openings for transmitting air flow;

a fan blade disposed in said housing means;

a motor disposed in said housing means and rotatably coupled to said fan blade;

an elongated tubular support means having vertically extending opposite end portions attached to said housing means and an intermediate stand portion shaped and arranged to support said housing means on a surface;

electrical control means connected to said motor;

retainer means retaining said electrical control means and fixed to one of said opposite end portions, said retainer means comprising a box enclosing said electrical control means; and locator means comprising an aperture and a stem received thereby for establishing a relative position between said retainer means and said support means, and fastener means securing said retainer means to said support means.

2. A fan according to claim 1 wherein said intermediate portion comprises intersecting leg portions disposed substantially in a given plane.

3. A fan according to claim 2 wherein said opposite end portions project transversely to said given plane.

4. A fan according to claim 3 wherein said elongated tubular support means is a continuous member.

5. A fan according to claim 4 wherein said housing means comprises a substantially cylindrical portion having ends defining said inlet and outlet openings.

6. A fan according to claim 5 wherein terminal portions of said opposite ends are fixed to substantially diametrically disposed positions on said cylindrical portion.

7. A fan according to claim 1 wherein said stem and said fastener means are threaded engaged.

8. A fan according to claim 1 wherein said intermediate portion comprises intersecting leg portions disposed substantially in a given plane.

9. A fan according to claim 8 wherein said opposite end portions project transversely to said given plane.

10. A fan according to claim 9 wherein said elongated tubular support means is a continuous member.

11. A fan according to claim 10 wherein said housing means comprises a substantially cylindrical portion having ends defining said inlet and outlet openings.

12. A fan according to claim 11 wherein terminal portions of said opposite end portions are fixed to substantially diametrically disposed positions on said cylindrical portion.

13. A fan according to claim 12 wherein said support means defines an aperture, and said retainer means comprises a stem received by said aperture and fastener means securing said stem within said aperture.

14. A fan according to claim 2 wherein said opposite end portions extend in parallel directions having components both parallel and perpendicular to said given plane.

15. A fan according to claim 14 wherein said leg portions comprise three leg portions arranged in a U-shape.

16. A fan according to claim 1 wherein said aperture is defined by said support means, and said retainer means comprises said stem.

* * * * *